US005614925A

United States Patent [19]

Braudaway et al.

[11] Patent Number: 5,614,925

[45] Date of Patent: Mar. 25, 1997

[54] METHOD AND APPARATUS FOR CREATING AND DISPLAYING FAITHFUL COLOR IMAGES ON A COMPUTER DISPLAY

[75] Inventors: Gordon W. Braudaway, Yorktown Heights, N.Y.; Helen R. Delp, Rochester, Minn.

[73] Assignee: International Business Machines Corporation, Armonk, N.Y.

[21] Appl. No.: 464,928

[22] Filed: Jun. 5, 1995

Related U.S. Application Data

[62] Division of Ser. No. 974,862, Nov. 10, 1992, Pat. No. 5,502,458.

[51] Int. Cl.[6] ..... G09G 5/04

[52] U.S. Cl. ..... 345/153; 395/131

[58] Field of Search ..... 345/153–155; 348/180, 470, 474, 557, 558, 517, 519, 520, 630, 631, 488, 453, 496, 503; 395/131

[56] References Cited

U.S. PATENT DOCUMENTS

| | | | |
|---|---|---|---|
| 4,439,759 | 3/1984 | Fleming et al. | 340/703 |
| 4,500,908 | 2/1985 | Mandeberg | 348/453 |
| 4,740,833 | 4/1988 | Shiota et al. | 348/453 |
| 4,985,853 | 1/1991 | Tayler et al. | 364/521 |
| 5,233,684 | 8/1993 | Ulichney | 345/154 X |
| 5,255,081 | 10/1993 | Miyamoto et al. | 348/453 X |
| 5,258,826 | 11/1993 | Wakeland et al. | 348/488 |

OTHER PUBLICATIONS

"The *Color* –*Calibration* Spectrum", S. Hannaford, Jan. 8, 1991, MacWeek, vol. 5, Issue nl, p. 41 (1).

"An Analysis of Selected Computer Interchange Color Spaces", J. M. Kasson et al., Aug. 1991, Res–San Jose.

"Displaying Multispectal Images on Video Terminals in RGB Color", A. Lin et al., May 20–24, 1990, 10th Annual International Geoscience and Remote Sensing Symposium – IGARSS 90, College Park MD.

"New Paradigms for Visualization", Murch, GM, IEEE Comt. Soc., Los Alamitos, CA, USA, 1990, pp. 550–551.

"RGB to CMYK: What Does It Mean?", B. Frase, MacWEEK vol. 5, Issue n33, p. 23 (3), Oct. 1, 1991.

*Primary Examiner*—Ulysses Weldon
*Attorney, Agent, or Firm*—Steven W. Roth; Schmeiser, Olsen & Watts

[57] ABSTRACT

Faithful color images are created in an efficient manner for display on a specific computer display. A standard computer system generates a palette calibration table, based on information about a standard display. The standard computer system then creates a device independent image from the palette calibration table and from an original image. The palette calibration table and device independent image are then transmitted to a specific computer system. The specific computer system receives the palette calibration table and device independent image from the standard computer system. It calculates a display specific palette from the palette calibration table and from information about the specific display. The specific computer system then generates the faithful color image for display by sending the device independent image and the display specific palette to the display adapter in the specific computer system.

20 Claims, 13 Drawing Sheets

Palette palette digital driving signals

| entry | r | g | b |
|---|---|---|---|
| 32 | 0 | 0 | 0 |
| 33 | 0 | 0 | 85 |
| 34 | 0 | 0 | 170 |
| 35 | 0 | 0 | 255 |
| 36 | 0 | 36 | 0 |
| 37 | 0 | 36 | 85 |
| 38 | 0 | 36 | 170 |
| 39 | 0 | 36 | 255 |
| 40 | 0 | 72 | 0 |
| 41 | 0 | 72 | 85 |
| 42 | 0 | 72 | 170 |
| 43 | 0 | 72 | 255 |
| 44 | 0 | 109 | 0 |
| 45 | 0 | 109 | 85 |
| 46 | 0 | 109 | 170 |
| . | . | . | . |
| . | . | . | . |
| 80 | 42 | 145 | 0 |
| . | . | . | . |
| . | . | . | . |
| 237 | 255 | 109 | 85 |
| 238 | 255 | 109 | 170 |
| 239 | 255 | 109 | 255 |
| 240 | 255 | 145 | 0 |
| 241 | 255 | 145 | 85 |
| 242 | 255 | 145 | 170 |
| 243 | 255 | 145 | 255 |
| 244 | 255 | 182 | 0 |
| 245 | 255 | 182 | 85 |
| 246 | 255 | 182 | 170 |
| 247 | 255 | 182 | 255 |
| 248 | 255 | 218 | 0 |
| 249 | 255 | 218 | 85 |
| 250 | 255 | 218 | 170 |
| 251 | 255 | 218 | 255 |
| 252 | 255 | 255 | 0 |
| 253 | 255 | 255 | 85 |
| 254 | 255 | 255 | 170 |
| 255 | 255 | 255 | 255 |

FIG. 2B

Normalized Palette Table palette Tristimulus values

| entry | R | G | B |
|---|---|---|---|
| 32 | 0 | 0 | 0 |
| 33 | 0 | 0 | 285 |
| 34 | 0 | 0 | 1521 |
| 35 | 0 | 0 | 4095 |
| 36 | 0 | 27 | 0 |
| 37 | 0 | 27 | 285 |
| 38 | 0 | 27 | 1521 |
| 39 | 0 | 27 | 4095 |
| 40 | 0 | 106 | 0 |
| 41 | 0 | 106 | 285 |
| 42 | 0 | 106 | 1521 |
| 43 | 0 | 106 | 4095 |
| 44 | 0 | 381 | 0 |
| 45 | 0 | 381 | 285 |
| 46 | 0 | 381 | 1521 |
| . | . | . | . |
| . | . | . | . |
| 80 | 40 | 843 | 0 |
| . | . | . | . |
| . | . | . | . |
| 236 | 4095 | 381 | 0 |
| 237 | 4095 | 381 | 285 |
| 238 | 4095 | 381 | 1521 |
| 239 | 4095 | 381 | 4095 |
| 240 | 4095 | 853 | 0 |
| 241 | 4095 | 853 | 285 |
| 242 | 4095 | 853 | 1521 |
| 243 | 4095 | 853 | 4095 |
| 244 | 4095 | 1601 | 0 |
| 245 | 4095 | 1601 | 285 |
| 246 | 4095 | 1601 | 1521 |
| 247 | 4095 | 1601 | 4095 |
| 248 | 4095 | 2592 | 0 |
| 249 | 4095 | 2592 | 285 |
| 250 | 4095 | 2592 | 1521 |
| 251 | 4095 | 2592 | 4095 |
| 252 | 4095 | 4095 | 0 |
| 253 | 4095 | 4095 | 285 |
| 254 | 4095 | 4095 | 1521 |
| 255 | 4095 | 4095 | 4095 |

FIG. 2C

Palette Calibration Table

| palette entry | CIE Tristimulus values X* | Y* | Z* |
|---|---|---|---|
| 32 | 0.0 | 0.0 | 0.0 |
| 33 | 1.6 | 0.7 | 8.4 |
| 34 | 8.6 | 3.6 | 44.6 |
| 35 | 23.3 | 9.8 | 120.0 |
| 36 | 0.2 | 0.4 | 0.0 |
| 37 | 1.8 | 1.1 | 8.4 |
| 38 | 8.8 | 4.1 | 44.6 |
| 39 | 23.5 | 10.2 | 120.1 |
| 40 | 0.8 | 1.7 | 0.2 |
| 41 | 2.4 | 2.4 | 8.5 |
| 42 | 9.4 | 5.4 | 44.8 |
| 43 | 24.1 | 11.5 | 120.2 |
| 44 | 2.8 | 6.2 | 0.7 |
| 45 | 4.4 | 6.9 | 9.1 |
| 46 | 11.4 | 9.8 | 45.3 |
| . | . | . | . |
| . | . | . | . |
| 80 | 6.7 | 14.1 | 1.6 |
| . | . | . | . |
| . | . | . | . |
| 237 | 49.9 | 30.7 | 10.6 |
| 238 | 56.9 | 33.6 | 46.8 |
| 239 | 71.6 | 39.8 | 122.3 |
| 240 | 51.7 | 37.6 | 3.1 |
| 241 | 53.4 | 38.3 | 11.5 |
| 242 | 60.4 | 41.3 | 47.7 |
| 243 | 75.0 | 47.4 | 123.2 |
| 244 | 57.2 | 49.8 | 4.5 |
| 245 | 58.8 | 50.5 | 12.9 |
| 246 | 65.8 | 53.4 | 49.1 |
| 247 | 80.5 | 59.6 | 124.6 |
| 248 | 64.4 | 65.8 | 6.4 |
| 249 | 66.1 | 66.5 | 14.7 |
| 250 | 73.1 | 69.5 | 50.9 |
| 251 | 87.7 | 75.6 | 126.4 |
| 252 | 75.4 | 90.2 | 9.1 |
| 253 | 77.0 | 90.9 | 17.5 |
| 254 | 84.1 | 93.9 | 53.7 |
| 255 | 98.7 | 100.0 | 129.2 |

FIG. 2D

Normalized Luminance Tables:

| digital driving signal | red norm luminance | digital driving signal | green norm luminance | digital driving signal | blue norm luminance |
|---|---|---|---|---|---|
| 0 | 0 | 0 | 0 | 0 | 0 |
| 42 | 40 | 36 | 27 | 85 | 285 |
| 85 | 237 | 72 | 106 | 170 | 1521 |
| 127 | 630 | 109 | 381 | 255 | 4095 |
| 170 | 1386 | 145 | 853 | | |
| 212 | 2448 | 182 | 1601 | | |
| 255 | 4095 | 218 | 2592 | | |
| | | 255 | 4095 | | |

FIG. 2E

METHOD AND APPARATUS FOR CREATING AND DISPLAYING FAITHFUL COLOR IMAGES ON A COMPUTER DISPLAY

This is a divisional of application Ser. No. 07/974,862 filed on Nov. 10, 1992 now U.S. Pat. No. 5,502,458.

BACKGROUND OF THE INVENTION

The present invention relates to methods and apparatus for creating and displaying faithful color images on a computer-driven display. More particularly, the invention relates to a method for creating a display-independent palettized image for presentation on a display controlled by a display adapter that contains a display-dependent palette.

The electronic equipment associated with computer-driven displays utilize display adapters for creating numerical representations of colors. Display adapters usually have digital to analog (D/A) converters for each of the three primary colors—red, green and blue. These converters are driven by normalized digital driving signals. The number of binary bits which a D/A converter is capable of dealing with provides a measure of the resolution of the converter, and determines the number of colors from which color palette entries can be chosen. The display adapter also has an image memory, representative of the display pixels, and the number of binary bits per pixel in this memory determines the number of color palette entries that can be used to display a pixel. Usually, the number of palette entries is greatly less than the number of possible color palette choices. The color palette that determines which colors will be used in an image is defined by specific normalized digital driving signals for each color entry in the palette. For example, one practical embodiment of a color display utilizes eight binary bits to define the digital driving signals of each of the three primary colors red, green and blue. This allows for 256 different intensity levels for each primary color. Since a single pixel accommodates three colors, the number of different color choices which are possible for a pixel are $256^3$, or 16,777,216. However, a typical number of colors which may be selected as color palette entries are 256 colors, which means that a color palette must be developed that has only 256 colors out of a possible 16 million plus different choices. Color palette entries are usually chosen so as to more or less uniformly extend across the gamut of all color choices, thereby leaving a large number of possible color choices between each actual color selected as a palette entry.

There exist a number of international standards for color measurement. The most prominent international standards for color measurement are collectively termed the Commission Internationale D l'Eclairage, or International Commission on Illumination (CIE system). The CIE system is based on the premise that specific perceived colors result from the proper combination of an illuminant or reference light source, an object, and an observer. A useful explanation of the CIE system is provided in "Principles of Color Technology," Section 2B and 2C, Edition 1981, by Billmeyer and Saltzman. U.S. Pat. No. 4,985,853, issued Jan. 15, 1991, provides a description of the CIE system, and other information relevant to three-dimensional color specification systems. It is presumed that these techniques are known to those having skill in this art.

Current methods for displaying faithful color images on computer-driven displays require that images be prepared for each specific display, thereby consuming a significant amount of computation time and requiring a significant storage space. An image which is to be displayed on a color display is typically represented by three binary values per pixel, each representing a standard CIE tristimulus value, X, Y or Z, and by further binary information which locates the horizontal and vertical coordinates of the pixel on the display screen. The three binary values that define the desired color for each pixel do not necessarily correspond to the colors selected for the color palette that are available in the system to present the image on the display. There therefore needs to be a process of color matching available to the system, wherein the desired image colors (per pixel) may be color matched to the closest palette color available in the system. This process is referred to as "palettizing," wherein a display-ready image is constructed to most closely color match the desired image but using only the available palette colors; each pixel of the display-ready image contains the index of the palette entry desired for that pixel. Two common techniques which are used for palettizing an image are known as "dithering" and "error-diffusion."

The palettizing techniques which are presently known in the art prepare an image for a specific color palette, where the palette is defined as a plurality of chosen colors, each color defined by specific primary color digital driving signal values for red, green and blue. For a given pixel, if the desired color is modified to that of the closest available color palette entry, the palettizing technique will apportion any resulting color error onto adjacent pixels, so as to average out the color differences and more faithfully reproduce a color image overall. However, displays may have differing color presentation characteristics, which complicate this problem; for example, the colors of the phosphors and the luminance (color intensity) response to a given digital drive signal may vary from one display to another. This means that a palettized image will match a desired image only if it is displayed on an identical display, but it may not match on another display.

If the chrominance and luminance response characteristics of each display are known, it is possible to prepare a palettized image that closely approximates with a desired image, but the palettized image will be unique for each display. This means that a single palettized image cannot be prepared for use on all displays of a given type if faithful color is desired. Multiple palettized images for multiple displays require an excessive amount of computation time for their preparation and an excessive amount of storage space for their storage.

In the prior art, the overall process of faithfully displaying a color image on a particular system or display involves at least three operative series of steps. The first series of steps deal with calibrating a particular computer-driven display; the second series of steps deal with preparing a display-specific palettized image for display on the system; the third series of steps deal with actually displaying the prepared image on the system.

The overall process objectives in the prior art are to first determine a matrix of transformation that will transform desired pixel colors, represented as CIE standard tristimulus values (XYZ), into display-specific RGB tristimulus values, to determine a suitable color palette, to measure the XYZ values of each palette entry on a specific display, to compute the RGB tristimulus values that correspond to the measured XYZ values for the palette entries, and to build a display-specific normalized palette table containing these RGB tristimulus values of the palette entries. Next, each pixel of the desired image is replaced by the palette entry index of the closest matching color in the normalized palette table, and any resulting color mismatches are apportioned to adjacent pixels using standard halftoning techniques. The resulting image is a display-specific palettized image that faithfully represents the desired image. Finally, the palette and the display-specific palettized image are copied into the display adapter.

The disadvantage with this prior art process is that each pixel of each image must be re-palettized for each specific display, using the normalized palette table unique to that display. The computation necessary to palettize each image is very substantial, and it must be repeated each time each image is to be displayed on a display that has different chrominance and luminance characteristics.

SUMMARY OF THE INVENTION

The present invention incorporates a process which defines a display-independent "standard" normalized palette table with reference to a "standard" display. The overall process objectives in the present invention are to first determine a matrix of transformation that will transform desired pixel colors, represented as CIE XYZ tristimulus values, into RGB tristimulus values that are referenced to the standard display, to determine a suitable color palette, to measure the XYZ* values of each palette entry on the standard display, to compute the RGB* tristimulus values that correspond to the measured XYZ* values for the palette entries, and to build a display-independent normalized palette table containing these RGB* tristimulus values of the palette entries. Next, each pixel of the desired image is replaced by the palette entry index of the closest matching color in the display-independent normalized palette table, and any resulting color mismatches are apportioned to adjacent pixels using standard halftoning techniques. The resulting image is the display-independent palettized image that faithfully represents the desired image. Next, each display on which a display-independent palettized image is to be displayed is calibrated so that its RGB values, and the digital driving signals that produce them, are the closest match to corresponding standard XYZ* values; a display-specific palette is constructed for each display from the digital driving signals so determined. Finally, the display-specific palette and the standard palettized image are copied into the display adapter.

The advantages of the process of the present invention are that each pixel of each image must be palettized only once, for the "standard" display using the display-independent normalized palette table. This represents a very substantial reduction in the amount of computing required when compared to that of current art, which requires a distinct palettized image for each image for each display. The display-specific palette must be computed for each display on which a standard image is to be displayed, but each display-specific palette must be computed only once for each display. Only one copy of each palettized image, the display-independent, must be stored, as compared to storing a distinct copy of each image for each different display, as required by current art. A copy of each display-specific palette must be stored for each different display, but the required storage for a palette is very much less than that required for a palettized image.

It is the principal object of the present invention to provide a system for displaying faithful color reproductions of images on displays having differing color reproduction characteristics.

It is another object of the invention to provide faithful image color reproduction by producing only a single palettized image for presentation on a plurality of displays, wherein the specific displays may have differing color presentation characteristics.

It is another object of the present invention to utilize a standard palette of color choices to develop display-specific palettes defining the digital driving signals which must be made to faithfully reproduce the standard color palette on a specific display monitor.

The advantages of the present invention include the faithful reproduction of the display image on a plurality of displays, wherein the display image is transmitted to the display adapter in unmodified display-independent form, and only the display-specific color palette need be modified for faithful reproduction.

Other objects and advantages of the invention will become apparent from the following specification and claims, and with reference to the appended drawings.

BRIEF DESCRIPTION OF THE DRAWINGS

FIGS. 2A-1 and 2A-2 show an overview of the creation and display of faithful color images in the preferred embodiment of the invention.

FIG. 2A-3 shows the steps performed by the standard computer in carrying out an alternate embodiment of the invention.

FIGS. 2B–2E show the tables of the invention.

DESCRIPTION OF THE PREFERRED EMBODIMENT

Figure 1:
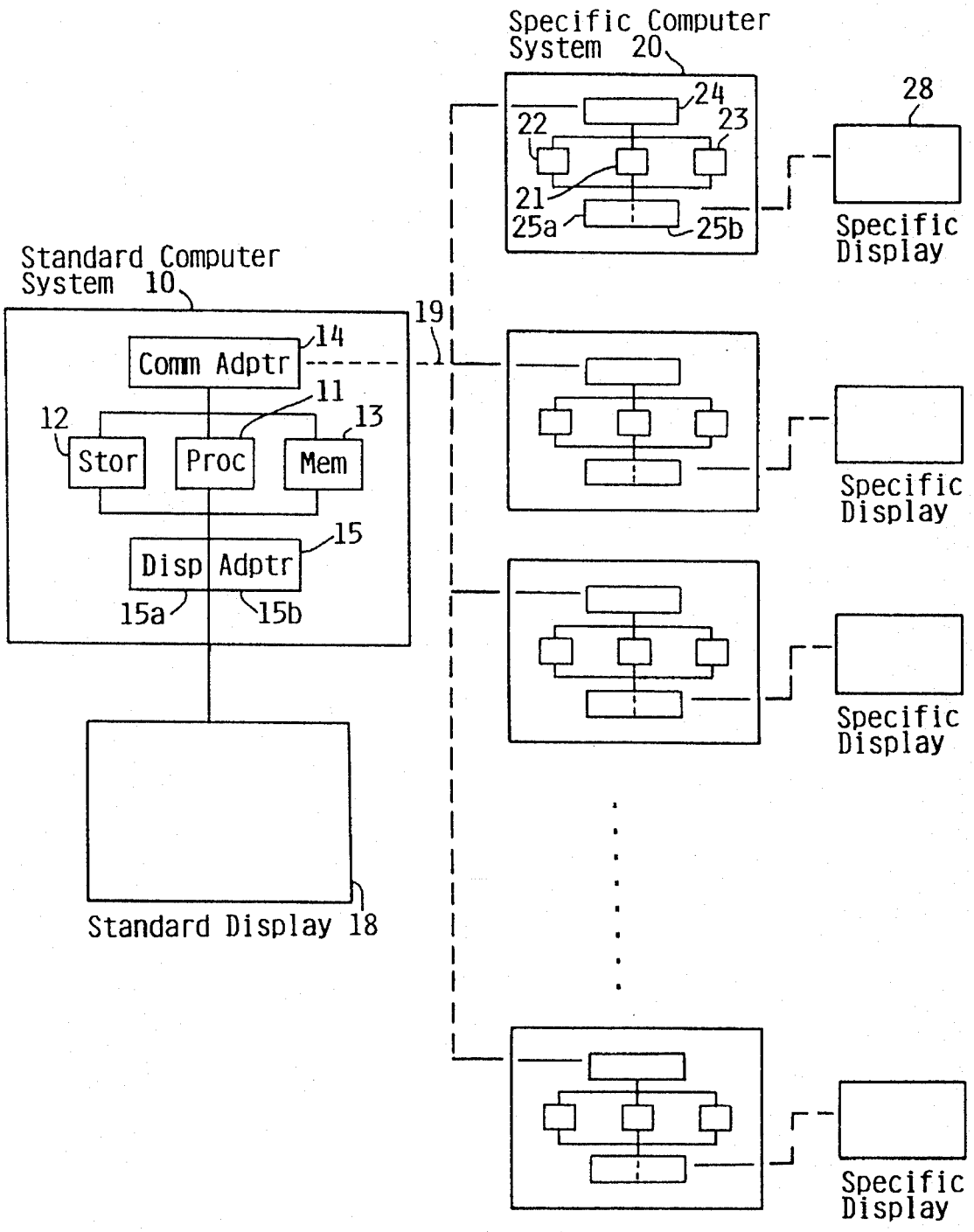
FIG. 1 shows the hardware block diagram of the computer systems of the invention.

As a prerequisite to practicing the inventive process, it is necessary to select a "standard" display. This can be accomplished by utilizing an independently-recognized standard, such as has been developed by the Society of Motion Picture and Television Engineers (SMPTE), or can be accomplished by selecting an average display within a group of displays. The group of displays can be all of the same make and model, or can be a more diverse group with similar color and non-linear properties.

If the standard display were selected from a group of displays having different phosphor colors, and it is desired to use the method to adjust for differences between the phosphor colors, the standard display could be chosen to have its phosphor colors among the least saturated of each of the phosphor colors, so that this color can be achieved on all of the displays. Known optimization techniques are used to balance between the loss of color purity by desaturating the phosphors, and the loss of color accuracy by allowing an error in the phosphor color. For best results, these optimization techniques should be executed in a visually uniform space, such as CIE L*u*v*, or CIE L*a*b*.

Once the standard display is selected, it is necessary to determine the matrix of transformation that converts colors expressed in CIE XYZ values to the RGB values of the display's phosphors. This computation is done in a known way by measuring the XYZ values of the individual red, green and blue display phosphors, each driven with a full-on digital driving signal, and "display white," which is the combination of all three phosphors driven with their full-on driving signals. This matrix is designated as M*.

The next prerequisite relating to the standard display is to select a palette for the standard display, according to any of the known techniques in the prior art. The color palette is defined in terms of the three driving signals that display each color. For ease of use, the majority of the entries in the palette may be orthogonal; that is, there may be a certain number of driving signals for red, green and blue, not necessarily the same, that are present in all combinations in the palette. This three-dimensional array of palette entries is used to present color images on the standard display, and the entries may be selected to span the color gamut in a manner that is as visually uniform as possible. Each standard palette entry is ordinarily specified in terms of its digital driving signals which are required in order to produce the color of the palette entry.

Once the standard palette is selected, it is necessary to measure the CIE XYZ tristimulus values of the display's phosphors resulting from each of the palette choices. These measured values, designated as the XYZ*'s, become the definition of the "standard" palette for this and all other displays that may be used, and are saved as the palette calibration table (note, if the standard display is defined in a formal specification, the XYZ*'s can be computed rather than measured). Once the XYZ*'s are obtained, the corresponding RGB* tristimulus values can be computed using the transformation matrix M*. The RGB*'s are normalized so that the brightest component of the brightest color is equal to one, and the normalized RGB*'s are saved as the display-independent normalized palette table.

The process steps for preparing a display-independent image parallel those for preparing a display-dependent image, discussed previously under prior art, but with several important distinctions. It is assumed that a desired digital image is available having its pixel colors defined by their CIE XYZ Tristimulus values, that is, by three digital values for each pixel that specify the normalized luminances of the X, Y and Z standard primary colors. The XYZ's of each pixel in the desired image are converted to the display-independent RGB tristimulus values using the display-independent matrix of transformation, M*, in place of the display-specific matrix, M, as in the prior art. Next, each pixel of the desired image is replaced by the palette entry index of the closest matching color in the display-independent normalized palette table, rather than the display-specific normalized palette table used in the prior art, and any resulting color mismatches are apportioned to adjacent pixels using standard halftoning techniques. The resulting image is a display-independent palettized image that faithfully represents the desired image if the "standard" palette is used.

But before a display-independent image can be displayed, a display-specific palette must be created for the display. Each display-specific palette is created to match the colors specified in the palette calibration table, the XYZ*'s, as closely as practicable. This is accomplished by first determining a matrix of transformation that will transform desired pixel colors, represented as CIE XYZ standard tristimulus values, into RGB tristimulus values of the specific display. Next, the tristimulus value Y, the luminance, of each of the three display phosphors is measured as a function of its digital driving signal, and those measurements are saved as normalized luminance tables for the specific display. Values in the normalized luminance tables are interpolated from the measurements so that for every discrete value of luminance, the generating digital driving value is known. Then the XYZ*'s of the palette calibration table are converted, one by one, to RGB tristimulus values using the matrix of transformation determined above that was computed for the specific display. The RGB tristimulus values so determined are identical to the display luminances of the three phosphors. Using these RGB values in place of display luminance values and the normalized luminance tables, the corresponding digital driving signals that would produce the luminances are determined. These display-specific digital driving signals are placed into the display-specific palette in the same order as their corresponding XYZ* values in the palette calibration table. For each display, a display-specific palette is produced in this manner, and it normally needs to be produced only once.

Finally, the display-independent palettized image and the display-specific palette are copied into the display adapter to effect display of the image.

FIG. 1 shows a hardware block diagram of standard computer system 10 and specific computer system 20 of the invention. Standard computer system 10 has processor 11, storage 12, memory 13, communications adapter 14, and display adapter 15. Processor 11 is suitably programmed to execute the flowcharts of the invention shown in FIGS. 4–5. Standard display 18 is connected to computer system 10 via display adapter 15. Display adapter 15 contains palette storage area **15*a* and image storage area 15*b***.

Specific computer system 20 contains processor 21, storage 22, memory 23, communications adapter 24, and display adapter 25. Processor 21 is suitably programmed to execute the flowcharts of the invention shown in FIGS. 6–7. Specific display 28 is connected to computer system 20 via display adapter 25. Display adapter 25 contains palette storage area **25*a* and image storage area 25*b***.

In the preferred embodiment, standard computer system 10 is an IBM AS/400 computer system, although other computer systems could be used. Standard computer system 10 is connected to one or more specific computer systems 20 via communications path 19. Specific computer systems 20 could also be IBM AS/400 computer systems, or could be IBM PS/2 computer systems or equivalent. While the preferred embodiment shows communications path 19 electronically connecting standard computer system 10 with specific computer systems 20, data to be sent to specific computer systems 20 can be stored on a transferable media such as optical disk, CD-ROM, tape, etc, and mailed or taken to specific computer systems 20 for loading.

Figures 1, 2A:
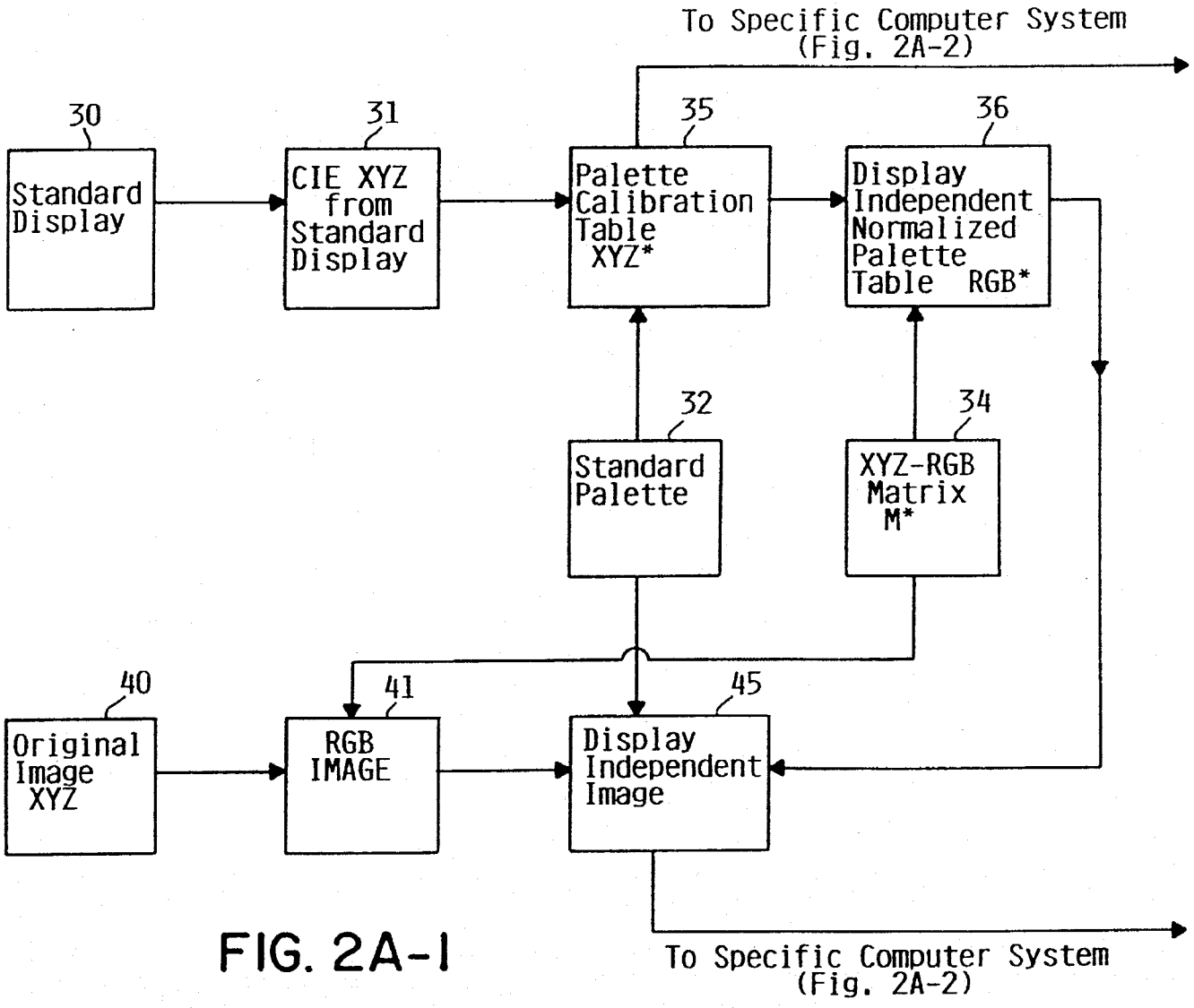
Figures 2, 2A:
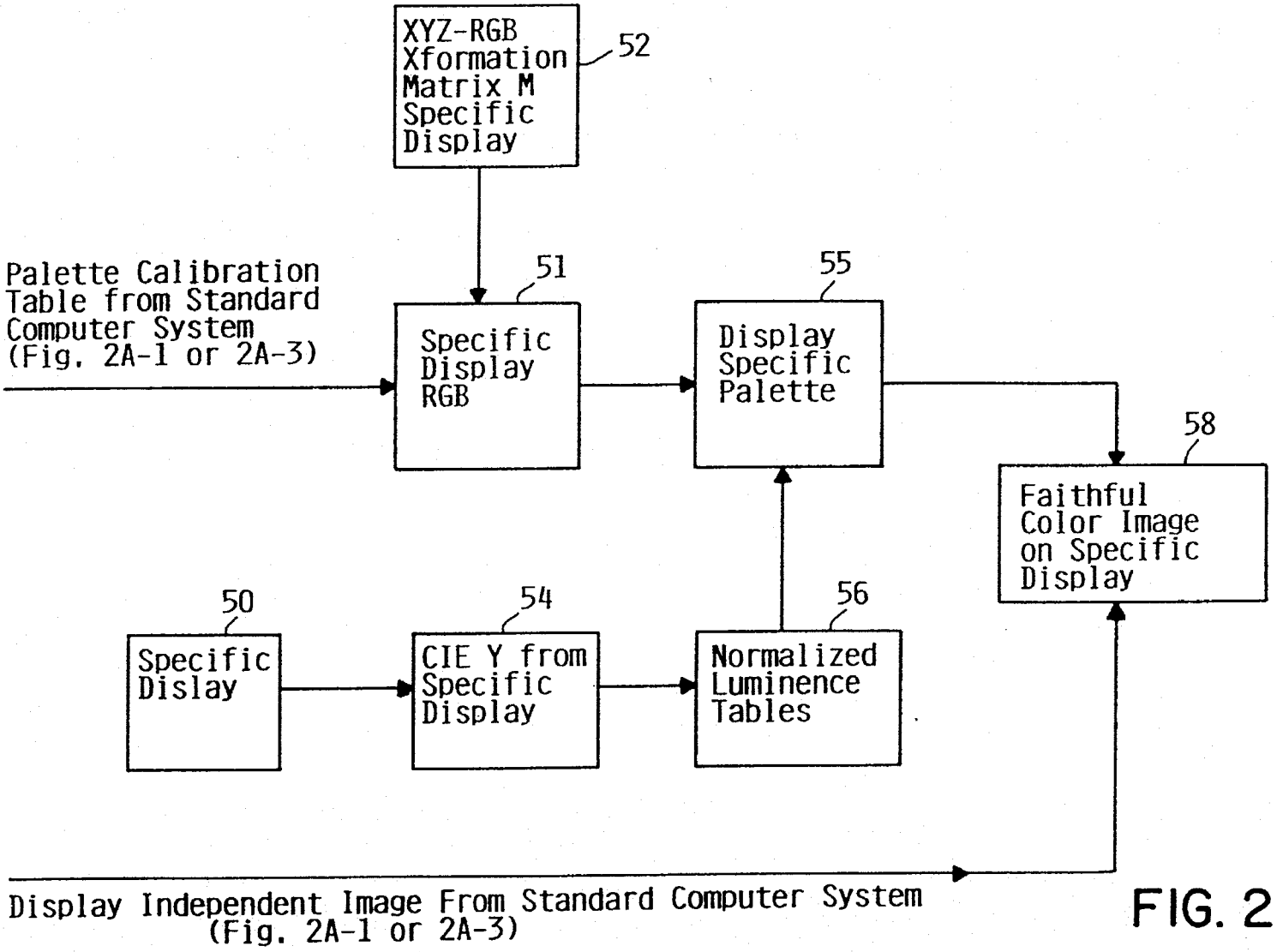

FIGS. 2A-1 and 2A-2 show an overview of the creation and display of faithful color images of the preferred embodiment of the invention. FIG. 2A-1 shows the steps performed by standard computer system 10 in carrying out the invention.

As will be explained in more detail in the flowchart of FIG. 4, the CIE XYZ tristimulus values 31 are obtained from standard display 30. These values, along with the values obtained from standard palette 32, are used to determine palette calibration table 35. In an alternate embodiment, palette calibration table 35 may be obtained directly from another standard computer system for use by standard computer system 10 (FIG. 1). In this alternate embodiment, blocks 30 and 31 of FIG. 2A-1 are not necessary. Palette calibration table 35 and XYZ-RGB Matrix M* are used to create display independent normalized palette table 36.

As will be explained in more detail in the flowchart of FIG. 5, RGB image 41 is created from original image 40 (also referred to herein as a desired image) and matrix 34. RGB image 41 is then used in conjunction with standard palette 32 to create display independent image 45. Palette calibration table 35 and display independent image 45 are then sent, either via communications line 19 (FIG. 1) or via transportable media (optical disk, CD ROM, tape, etc) to specific computer system 20 (FIG. 1).

FIG. 2A-2 shows the steps performed by specific computer system 20 in carrying out the invention. As will be explained in more detail in the flowchart of FIG. 6, specific display RGB values 51 are determined from XYZ-RGB transformation matrix M 52 and palette calibration table 35 (FIG. 2A-1). Normalized tristimulus luminance values Y 54 are determined from specific display 50. Y values 54 are used to compute normalized luminance tables 56. Specific display RGB values 51 and normalized luminance tables 56 are used to create display specific palette 55. As will be explained in more detail in the flowchart of FIG. 7, display specific palette 55 is loaded with display independent image 45 (FIG. 2A-1) in display adapter 25 (FIG. 1) to generate faithful color image 58 on specific display 28.

Figures 2, 2A, 3:
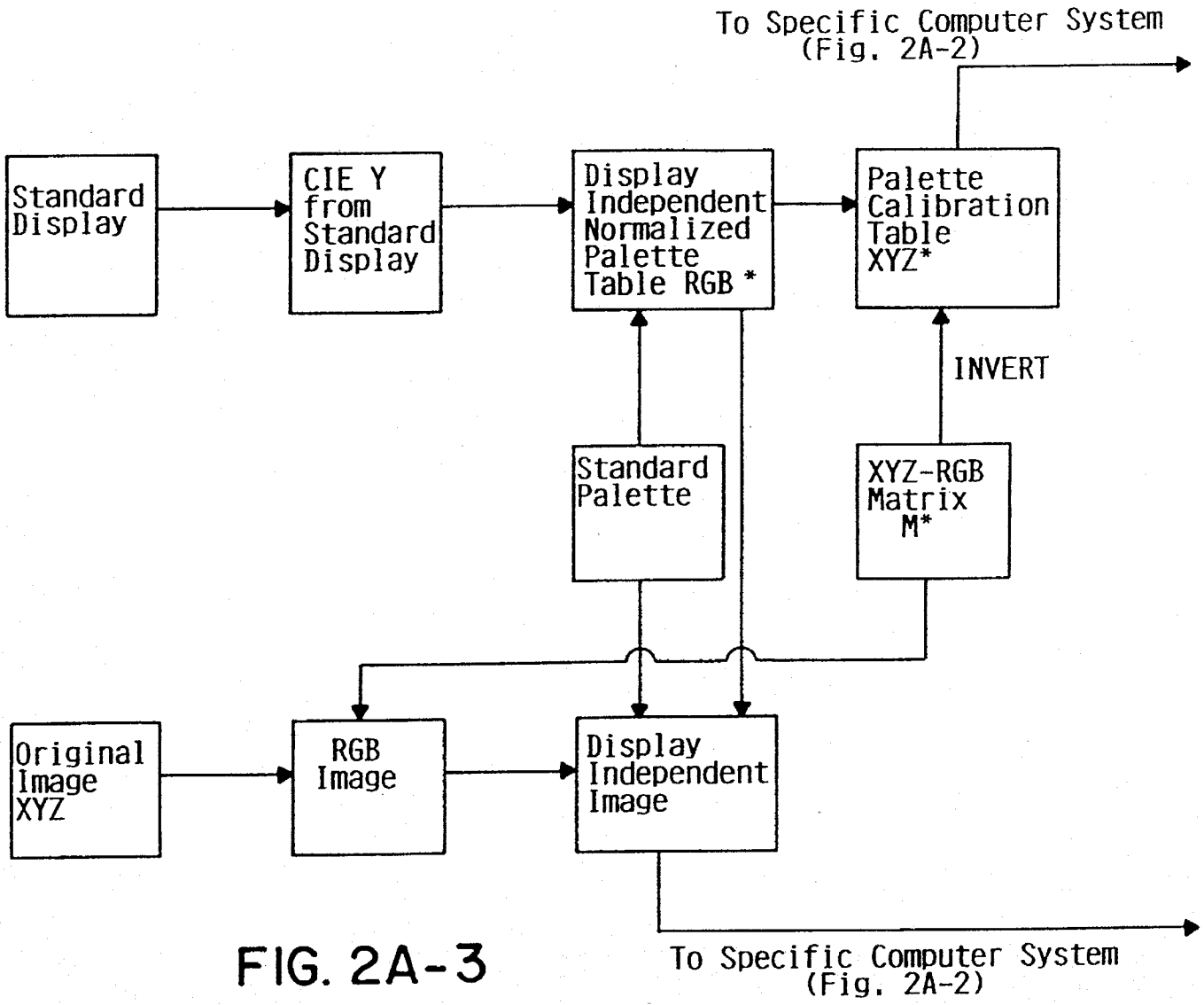

FIG. 2A-3 shows the steps performed by standard computer system 10 in an alternate embodiment of carrying out the invention. Note that this alternate embodiment performs the same general steps as the preferred embodiment of FIG. 2A-1 discussed in greater detail in FIGS. 4–5, but in a slightly different manner. In this embodiment, the display independent normalized palette table is computed directly from the CIE Y values from the standard display. It may be advantageous to do this if the palette used is an orthogonal palette, since fewer measurements need to be taken. The palette calibration table can then be calculated from the display independent normalized palette table and the inverse of the XYZ-RGB Matrix M*, or obtained from another standard computer system, as discussed above. Flowcharts corresponding to FIG. 2A-3 are not shown but could be easily derived by those skilled in the art from the flowcharts of FIGS. 4–5 and FIG. 2A-3.

FIGS. 2B–2E show the tables of FIGS. 2A-1 to 2A-3, containing exemplary data. Those skilled in the art will readily appreciate that the precise content of these tables is a design choice, and that other values could be selected and still fall within this invention.

Figure 3A:
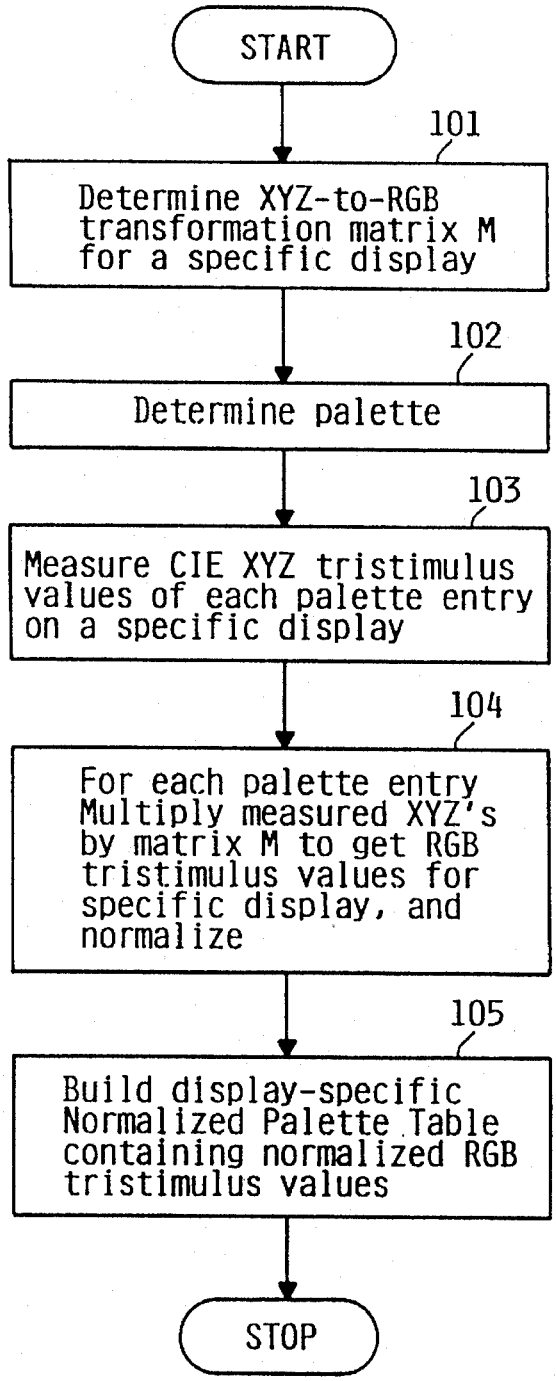
FIG. 3A (PRIOR ART)
FIG. 3A shows the prior art process steps for calibrating a display.

FIG. 3A shows the process for calibrating a specific display according to the teachings of the prior art. Box 101 refers to the process of developing a transformation matrix M by making a determination of the XYZ-to-RGB parameters for this specific display. This matrix therefore provides a conversion table for a specific display to permit XYZ values to be converted to RGB tristimulus values for that display. Box 102 refers to the step of determining the palette entries to be utilized in the system; this step involves the selection of the palette of color choices which is to be used on the system for all image presentations. The palette is normally specified by listing the digital driving signal levels or values required to produce the palette color entries. Box 103 refers to the step of measuring the CIE XYZ tristimulus values for each palette entry of the selected palette, on a specific display. This step provides a tabulation of the XYZ values for the specific display which corresponds to the respective palette entries. Box 104 refers to the step of multiplying the measured XYZ's by the matrix M to get the specific RGB tristimulus values for each palette entry and for the specific display; after this calculation is made the values are normalized. Box 105 refers to the step of building a display-specific normalized palette table containing normalized RGB tristimulus values.

Figure 3C:
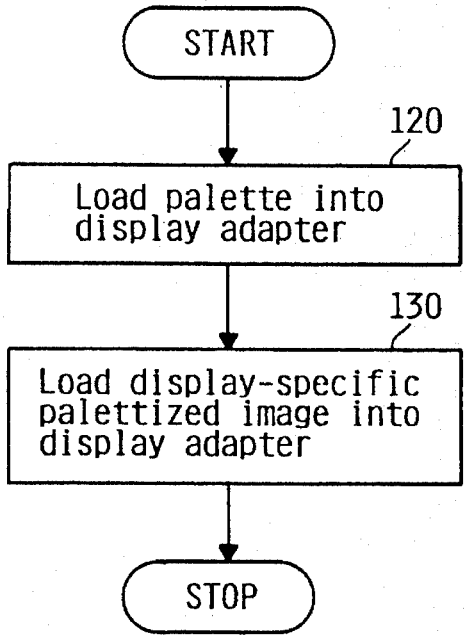
FIG. 3C (PRIOR ART)
FIG. 3C shows the prior art process steps for displaying a display-specific image.
Figure 3B:
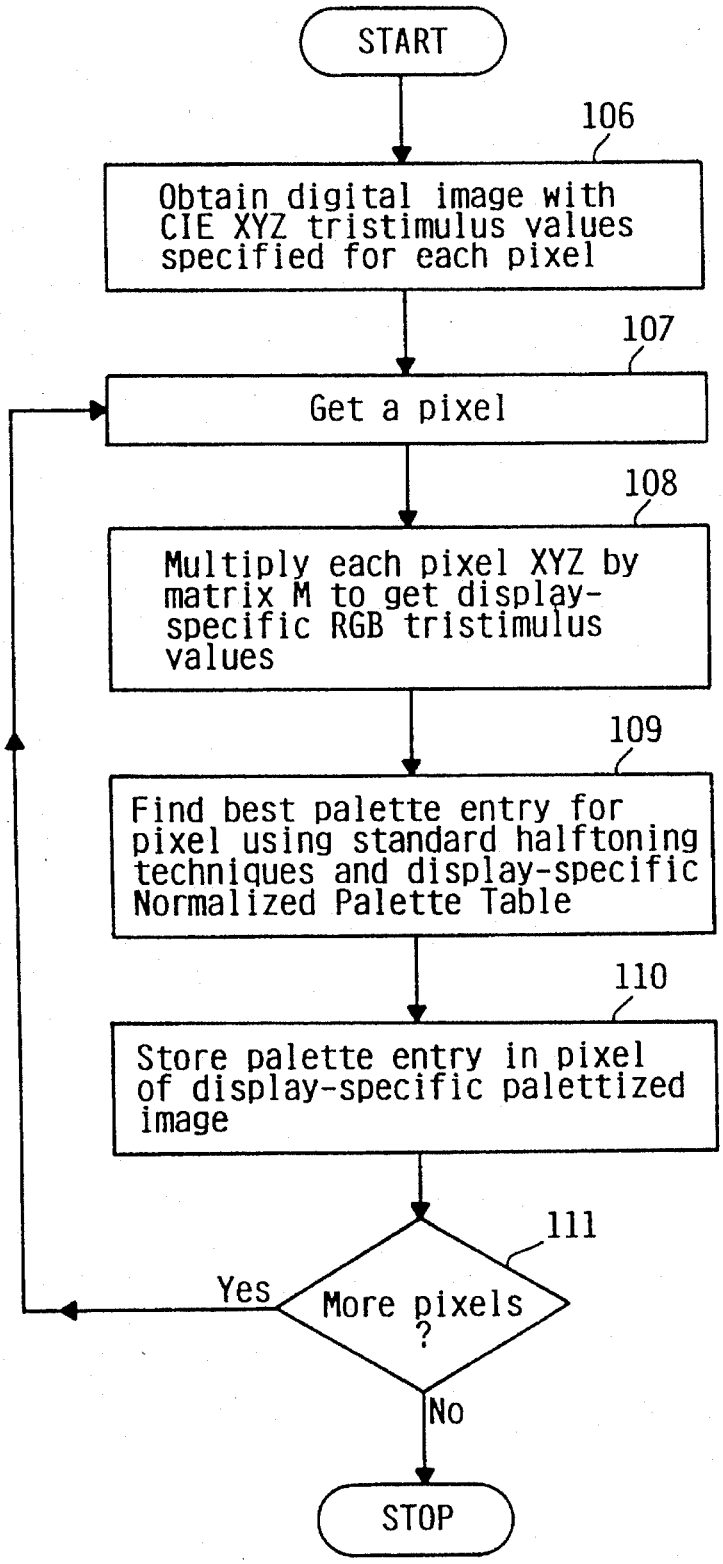
FIG. 3B (PRIOR ART)
FIG. 3B shows the prior art process steps for preparing a display-specific image.

FIG. 3B refers to the process steps for preparing a display-specific image according to the teachings of the prior art. Box 106 refers to the step of obtaining a particular digital image having the CIE XYZ tristimulus values specified for each pixel, according to techniques which are well known in the prior art. Box 107 refers to retrieving a first pixel for modification from the digital image set of pixels. In box 108, the specific pixel XYZ coordinates obtained from box 107 are multiplied by the matrix M in order to get a display-specific RGB tristimulus value. Box 109 refers to the matching process of finding the best palette entry for the pixel, using standard half-toning techniques and also using the display-specific normalized palette table described with reference to FIG. 3A. Box 110 refers to the step of storing the selected palette entry in the pixel location for the corresponding pixel of the display-specific palettized image. Box 111 refers to the repetitive sequence of repeating the steps of boxes 107–110 for each of the pixels comprising the image. At the completion of the overall process a display-specific palettized image has been constructed for actual display on the display.

FIG. 3C illustrates the steps required for displaying a display-specific image on a particular display. In these steps, box 120 refers to the loading step, wherein the palette is loaded into the display adapter logic associated with the specific display. Box 130 refers to the loading process for loading the display-specific palettized image into the display adapter, whereupon the image may be displayed by reference to each image pixel and to the palette for selection of the RGB digital drive signals.

According to the foregoing prior art techniques an image must be modified for each specific display on which it is to be presented. It is apparent that the process requires time and memory-consuming operational steps for each change of display in the system.

The prior art techniques are generally described in an article entitled "Organization of a System for Managing the Text and Images that Describe an Art Collection," Fred Mintzer and John D. McFall, proceedings of the Image Handling and Reproduction Systems Conference of the 1991 IS&T International Symposium on Electronics Imaging, San Jose, Calif., Feb. 26, 1991. A further discussion on this subject can be found in the article entitled "Color Properties and Color Calibration for a High-Performance, High-Fidelity Color Scanner," H. R. Delp, G. Goertzel, J. D. Lee, F. C. Mintzer, G. R. Thompson and H. S. Wong, proceedings of the Symposium on Electronic Photography of the IS&T's 44th Annual Conference, May 12–17, 1991.

Figure 4:
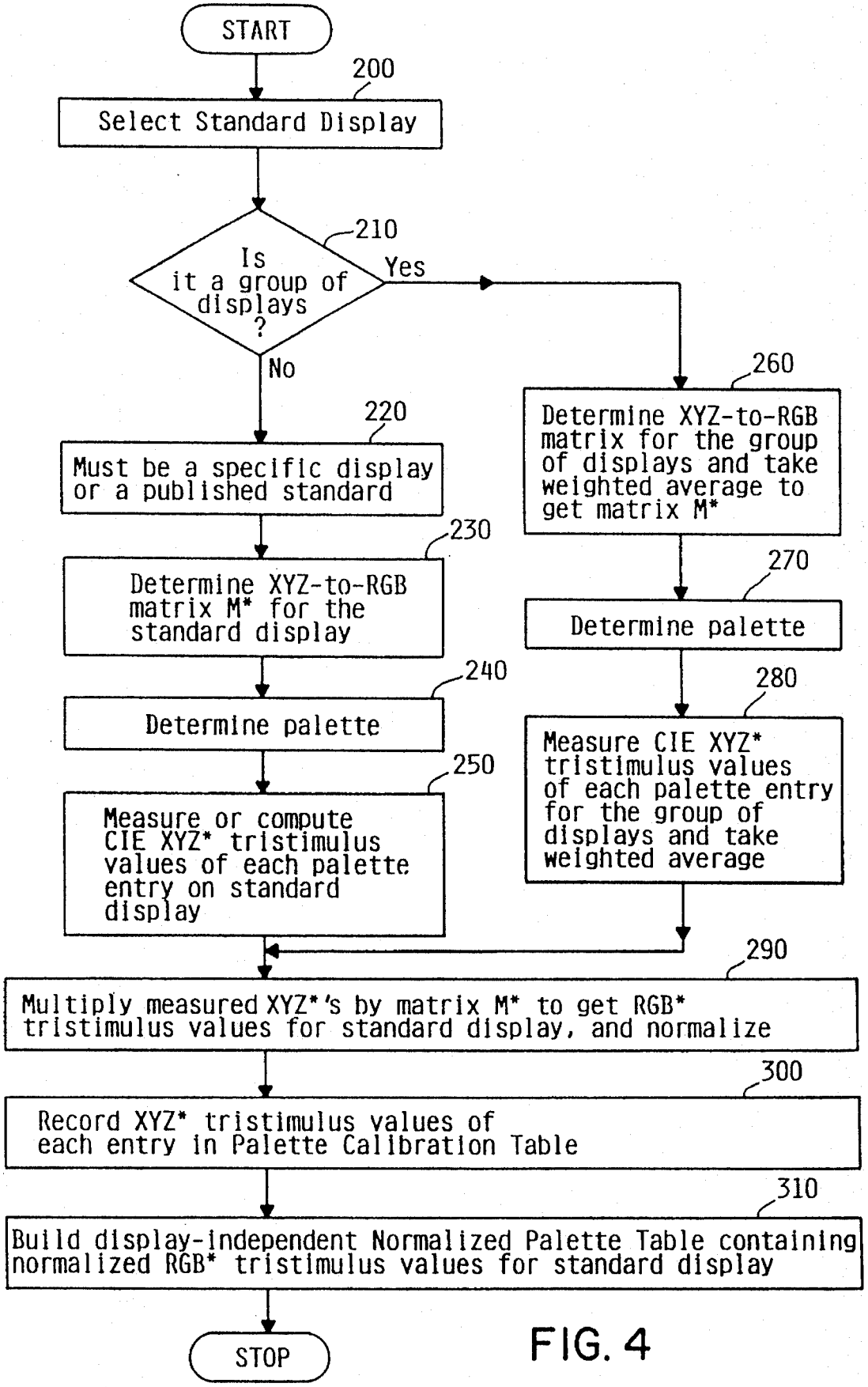
FIG. 4 shows the steps in calibrating a palette for the present invention executed by the standard computer system.

FIG. 4 shows the steps according to the teachings of the invention, required for calibrating a palette, as executed by processor 11 in standard computer system 10 (FIG. 1). Box 200 refers to the step of selecting a "standard" display, and step 210 refers to the alternative process steps relating to the "standard" display, depending upon whether it represents a single display or is to be representative of a group of displays. If a single display, box 220 refers to the requirement that the display may be either a specific display or one selected by utilizing industry standards, and box 230 refers to the step of making a determination of the XYZ-to-RGB matrix M* for the standard display. This determination may be made according to techniques which are well known in the art, and have been referred to herein. Box 240 refers to the step of determining the palette to be used in the system, and box 250 refers to the measurement step for computing the CIE XYZ* tristimulus values of each palette entry on the standard display.

Alternatively, if the selected display is representative of a group of displays box 260 refers to the step of determining the XYZ-to-RGB matrix for the group, and then taking a weighted average to develop the matrix M*. Box 270 refers to the step of determining a palette, which is identical to the step referred to in box 240. Box 280 refers to the step of measuring the CIE XYZ* tristimulus values of each palette entry for the overall group of displays, and then taking the weighted average, to develop the tristimulus values of each palette entry in a manner similar to that referred to in box 250.

In boxes 260 and 280, the weighted average is best performed in a visually uniform space such as CIE L*a*b* or CIE L*u*v*. It may be desirable to weight the averages toward the least saturated phosphors of the group so that all monitors can achieve the colors.

After either of the foregoing alternatives, box 290 refers to the step of multiplying the measured XYZ*'s by the matrix M* to get RGB* tristimulus values for the standard display, and then to normalize these values. Box 300 refers to the step of recording the XYZ* tristimulus values for each entry in a palette calibration table, and box 310 refers to the step of building a display-independent normalized palette table which contains the normalized RGB* tristimulus values for the standard display.

Figure 5:
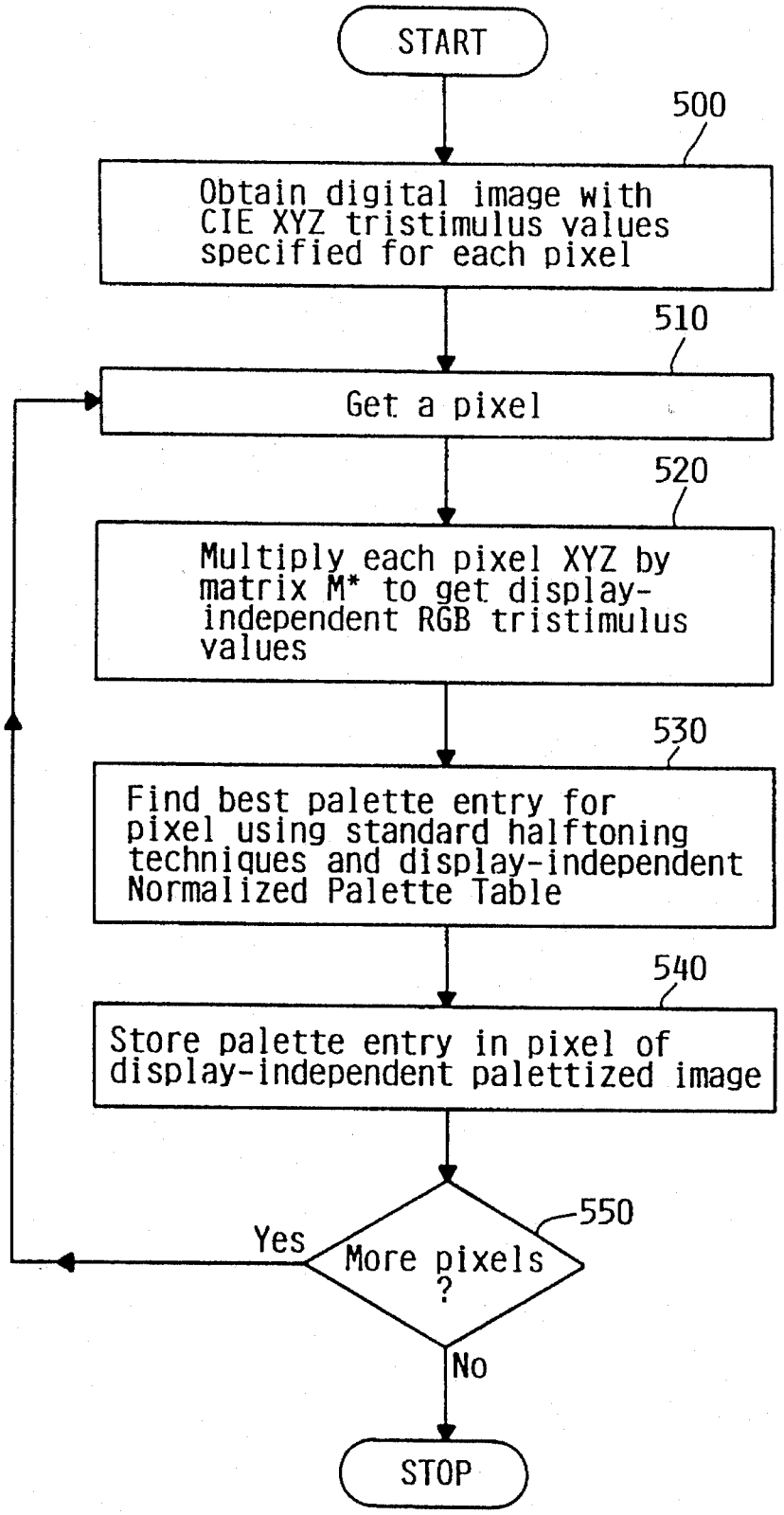
FIG. 5 shows the steps in preparing a display-independent image according to the present invention executed by the standard computer system.

FIG. 5 shows the steps required for preparing a display-independent image as executed by processor 11 in standard computer system 10 (FIG. 1). Box 500 refers to the step of obtaining a digital image having CIE XYZ tristimulus values specified for each pixel in the image. Box 510 refers to the step of retrieving the first pixel from the image referred to in box 500. Box 520 refers to the step of multiplying each pixel XYZ value by the matrix M* to get a display-independent RGB tristimulus value for that pixel. Box 530 refers to the step of identifying the best palette entry for the pixel, which can be achieved by using standard halftoning techniques, and the display-independent normalized palette table. Box 540 refers to the step of storing the palette entry in the corresponding pixel location relating to the display-independent palettized image. Box 550 refers to the step of determining whether more pixels remain to be examined in the image, which will require a repeat of the sequence 510–540 until no further pixels remain in the image.

A description of the halftoning techniques which are known in the prior art may be found in the article entitled "'Halftoning' Techniques for Displaying Images with a Limited Color Palette," G. Goertzel and G. R. Thompson, Electronic Imaging West '90, Pasadena, Calif.

Figure 6:
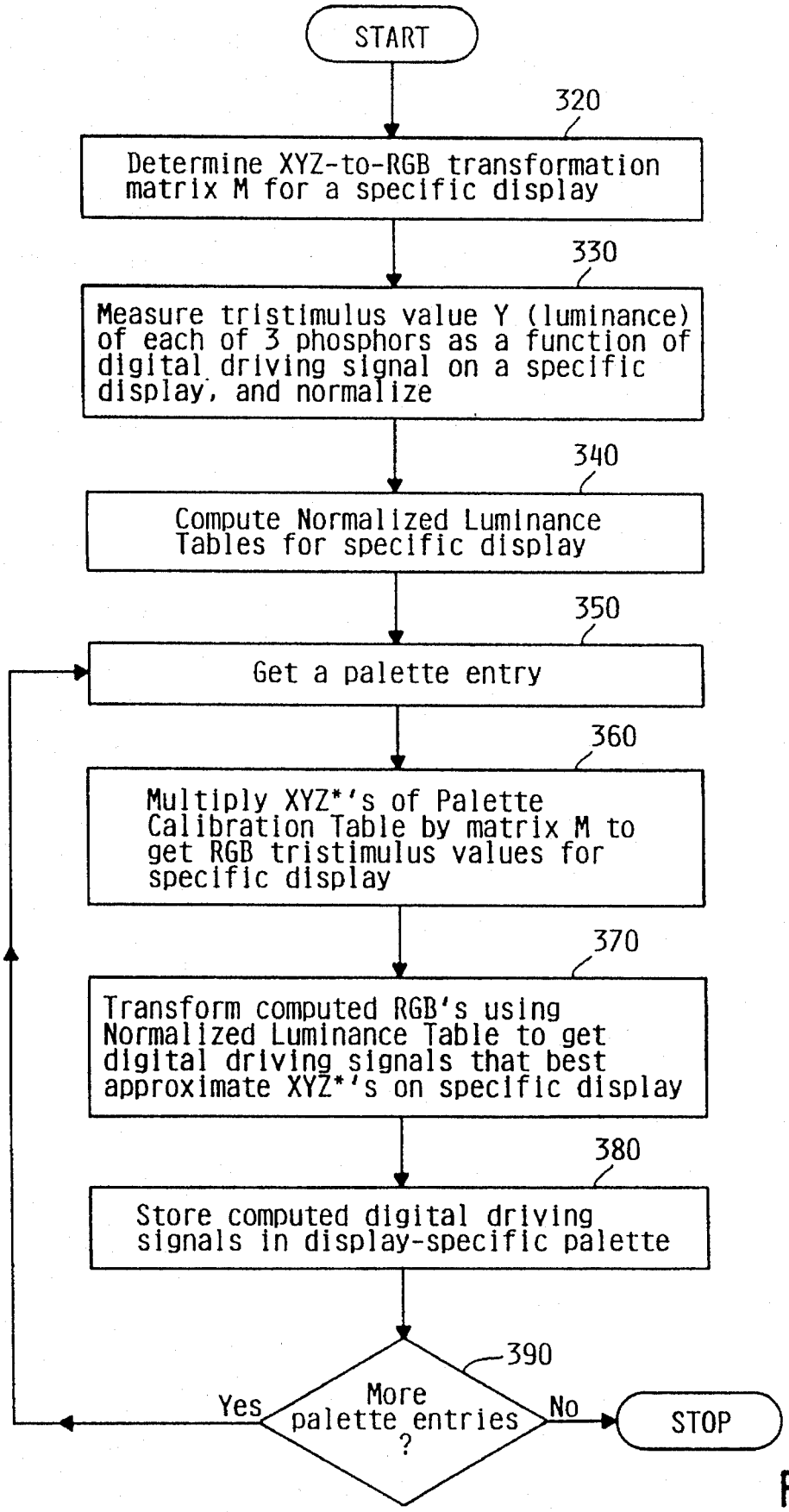
FIG. 6 shows the steps for creating a display-specific palette according to the present invention executed by the specific computer system.

FIG. 6 shows the steps of the invention required for preparing a display-specific palette, as executed by processor 21 of specific computer display 20 (FIG. 1). Box 320 refers to the step of determining an XYZ-to-RGB transformation matrix M for the specific display; this step is identical to the step referred to in box 101 of FIG. 3A. Box 330 refers to the step of measuring the tristimulus value Y (luminance) of each of the three phosphors in the specific display as a function of the digital driving signal for that display, and then normalizing the values. Box 340 refers to the step of computing the normalized luminance tables for the specific display. Box 350 refers to the step of obtaining a first palette entry for the subsequent process steps, and box 360 refers to the step of multiplying the XYZ*'s of the palette calibration table by the matrix M to get RGB tristimulus values for the specific display. This is similar to the process step referred to in box 104 for FIG. 3A. Box 370 refers to the step of transforming the computed RGB's using the normalized luminance table to get the digital driving signals that best approximate the XYZ*'s on the specific display. Box 380 refers to the step of storing the digital driving signal values which have been determined as a result of the step of box 370, in a display-specific palette. Box 390 refers to the decision of whether the overall process has been completed, for all palette entries selected for the display. If there are more palette entries to be processed, steps 350–380 are repeated until all palette entries have been processed.

Figure 7:
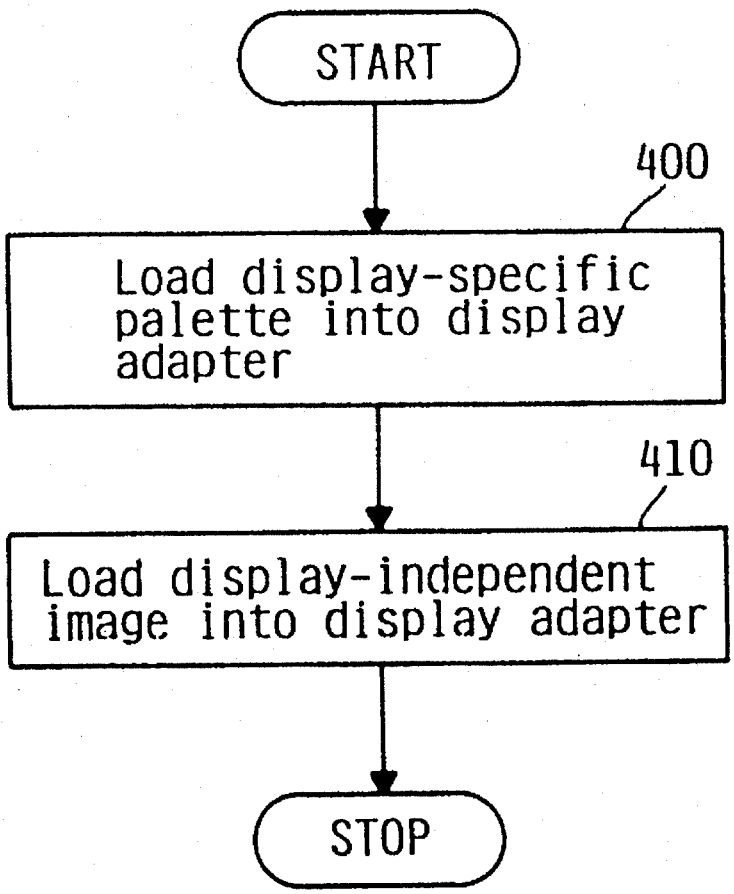
FIG. 7 shows the steps for displaying an image for the present invention executed by the specific computer system.

FIG. 7 shows the steps required for displaying an image according to the teachings of the invention, as executed by processor 21 of specific computer system 20 (FIG. 1). First, box 400 refers to loading the display-specific palette into the display adapter logic associated with the specific display. Box 410 refers to the step of loading the display-independent image into the same display adapter logic, whereupon the display is now ready for displaying the image in colors which faithfully represent the desired image colors.

The process steps of the present invention will work with any type of palette, with or without orthogonal palette entries; it will also work with a custom palette, i.e., one created for a specific image. In the preferred embodiment described herein, methods of measuring every display or every palette entry are described. However, those skilled in the art will know that there are many techniques for extracting the information from fewer measurements. For example, in order to determine the normalized luminance table, it is possible to make a model to describe the behavior of a display, take several measurements to calibrate the model, and then compute the values for the digital driving signals by interpolation. Also in FIG. 4, it is possible to measure the CIE XYZ* for just a few palette entries and determining values for the others using linear combinations of R, G, and B. There are also other techniques for creating a normalized palette table. For example, instead of measuring the CIE XYZ* tristimulus values of the palette entries and multiplying by the matrix M*, it is also possible to measure the luminance (Y value only) of each of the phosphors as a function of digital driving signals and use it to convert the digital driving signals of the palette to create a normalized RGB* tristimulus value.

In certain cases, where the standard display represents a group of displays with phosphor chromaticities that are very close, many of the benefits of the invention can be achieved without color correcting for the differences. This means that the standard matrix M* should be used rather than the display-specific matrix M in the steps for calibrating a display, (box 360 FIG. 6) for use with the display-specific palette.

The foregoing process technique can be very useful for images stored on compact disk (CD) and shared or transferred in this manner. For example, images could be stored palettized for the standard palette, with the palette calibration table given for each palette on the CD. Then the recipient of the image could display the image with faithful color without the creator of the CD knowing the color characteristics of the recipient's display. The technique could also be expanded to work with calibration techniques other than measurement. For example, there are many techniques for determining the normalized palette table by displaying a series of specially designed images, and then asking the user to pick the image that displays a pattern the best. There are similar techniques for performing color balance and approximating the matrix.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A method for displaying a faithful color image on a specific computer display connected to a specific computer system, comprising the steps of:

receiving a palette calibration table from a standard computer system;

receiving a display independent image from a standard computer system;

calculating a display specific palette from said palette calibration table and from information about said specific computer display;

generating said faithful color image from said display specific palette and from said display independent image; and displaying said faithful color image on said specific computer display.

2. The method of claim 1, wherein said calculating step further comprises the steps of:

determining an XYZ-RGB transformation matrix M for said specific display;

computing RGB tristimulus values for said specific display from said XYZ-RGB transformation matrix M and said palette calibration table; and transforming said RGB values using a normalized luminance table to obtain said display specific palette.

3. The method of claim 2, wherein said normalized luminance table used by said transforming step further comprises the steps of:

measuring luminance tristimulus values Y for said specific display;

normalizing said luminance tristimulus values Y; and computing said normalized luminance table from said luminance tristimulus values Y normalized in said normalizing step.

4. The method of claim 1, wherein said generating step further comprises the steps of:

sending said display specific palette to a display adapter in said specific computer system;

sending said display independent image to said display adapter; and combining said display specific palette and said display independent image in said display adapter.

5. A method in a standard computer system for creating information used to display a faithful color image on a specific computer display connected to a specific computer system, comprising the steps of:

generating a palette calibration table and a display independent normalized palette table from information about a standard display;

creating a display independent image from said display independent normalized palette table and from an original image;

transmitting said palette calibration table to said specific computer display via a communications path; and transmitting said display independent image to said specific computer display via a communications path.

6. The method of claim 5, wherein said generating step further comprises the steps of:

determining CIE XYZ* values from a group of displays;

averaging said CIE XYZ* values determined in said determining step;

obtaining a standard palette; and generating said palette calibration table from said CIE XYZ* values averaged in said averaging step and said standard palette.

7. The method of claim 5, wherein said generating step further comprises the steps of:

obtaining a standard palette;

determining CIE XYZ* values from said standard display; and generating said palette calibration table from said CIE XYZ* values and said standard palette.

8. The method of claim 5, wherein said creating step further comprises the steps of:

determining a XYZ-RGB matrix M* for said standard display;

obtaining a standard palette;

creating said display independent palette table from said XYZ-RGB matrix M* and said standard palette;

creating an RGB image from said original image;

creating said display independent image from said RGB image and said display independent palette table.

9. A method in a standard computer system for creating information used to display a faithful color image on a specific computer display connected to a specific computer system, comprising the steps of:

generating a palette calibration table from information about a standard display;

creating a display independent image from a display independent normalized palette table and from an original image;

storing said palette calibration table on a transportable media; and storing said display independent image on a transportable media.

10. A method for displaying a faithful color image on a specific computer display connected to a specific computer system, comprising the steps of:

in a standard computer system, generating a palette calibration table from information about at least one standard display;

creating a display independent image;

sending said palette calibration table to said specific computer display;

sending said display independent image to said specific computer display via a communications path;

in said specific computer system, receiving a palette calibration table from a standard computer system;

receiving a display independent image from a standard computer system;

calculating a display specific palette from said palette calibration table and from information about said specific computer display;

generating said faithful color image from said display specific palette and from said display independent image; and displaying said faithful color image on said specific computer display.

11. A transportable storage media having information used to display a faithful color image on a specific computer display connected to a specific computer system, comprising:

a palette calibration table generated from information about a standard display; and a display independent image created from said calibration table and from an original image.

12. A specific computer system having a specific computer display, said specific computer display capable of displaying a faithful color image, comprising:

means for receiving a palette calibration table from a standard computer system;

means for receiving a display independent image from a standard computer system;

means for calculating a display specific palette from said palette calibration table and from information about said specific computer display;

means for generating said faithful color image from said display specific palette and from said display independent image; and means for displaying said faithful color image on said specific computer display.

13. A standard computer system capable of creating information used to display a faithful color image on a specific computer display connected to a specific computer system, said standard computer system comprising:

means for generating a palette calibration table from information about a standard display;

means for creating a display independent image from a display independent normalized palette table and from an original image;

means for transmitting said palette calibration table to said specific computer display via a communications path; and means for transmitting said display independent image to said specific computer display via a communications path.

14. A network of computer systems capable of creating information used to display a faithful color image on a specific computer display connected to a specific computer system, said specific computer system being one of said network of computer systems, said network comprising:

a standard computer system, said standard computer system being one of said network of computer systems and comprising:

means for generating a palette calibration table from information about at least one standard display;

means for creating a display independent image from said calibration table and from an original image;

means for sending said palette calibration table to said specific computer display;

means for sending said display independent image to said specific computer display;

said specific computer system comprising:

means for receiving a palette calibration table from a standard computer system;

means for receiving a display independent image from a standard computer system;

means for calculating a display specific palette from said palette calibration table and from information about said specific computer display;

means for generating said faithful color image from said display specific palette and from said display independent image; and means for displaying said faithful color image on said specific computer display.

15. A method in a first standard computer system for creating information used to display a faithful color image on a specific computer display connected to a specific computer system, comprising the steps of:

receiving a palette calibration table from a second standard computer system;

creating a display independent image from said palette calibration table and from an original image; and transmitting said display independent image to said specific computer display via a communications path.

16. A method in a first standard computer system for creating information used to display a faithful color image on a specific computer display connected to a specific computer system, comprising the steps of:

receiving a palette calibration table from a second standard computer system;

creating a display independent image from said palette calibration table and from an original image; and storing said display independent image on a transportable media.

17. A method in a standard computer system for creating information used to display a faithful color image on a specific computer display connected to a specific computer system, comprising the steps of:

generating a palette calibration table from information about a standard display;

creating a display independent image from information about a standard display and from an original image;

transmitting said palette calibration table to said specific computer display via a communications path; and transmitting said display independent image to said specific computer display via a communications path.

18. A method in a first standard computer system for creating information used to display a faithful color image on a specific computer display connected to a specific computer system, comprising the steps of:

creating a display independent image from information about a standard display and from an original image;

receiving a palette calibration table from a second standard computer system; and transmitting said display independent image to said specific computer display via a communications path.

19. A method in a first standard computer system for creating information used to display a faithful color image on a specific computer display connected to a specific computer system, comprising the steps of:

creating a display independent image from information about a standard display and from an original image;

receiving a palette calibration table from a second standard computer system; and storing said display independent image on a transportable media.

20. A computer system, said computer system comprising:

a palette calibration table; and a display independent image, said palette calibration table and said display independent image having been created from information about a standard display.

* * * * *